US008516613B2

(12) United States Patent
Crites

(10) Patent No.: US 8,516,613 B2
(45) Date of Patent: Aug. 27, 2013

(54) SHOWER SHIRT AND METHOD OF USE

(76) Inventor: Lisa Crites, Rockledge, FL (US)

( * ) Notice: Subject to any disclaimer, the term of this patent is extended or adjusted under 35 U.S.C. 154(b) by 0 days.

(21) Appl. No.: 13/530,330

(22) Filed: Jun. 22, 2012

(65) Prior Publication Data

US 2012/0260393 A1 Oct. 18, 2012

Related U.S. Application Data

(63) Continuation of application No. PCT/US2010/061435, filed on Dec. 21, 2010.

(60) Provisional application No. 61/290,031, filed on Dec. 24, 2009.

(51) Int. Cl.
*A41D 13/00* (2006.01)

(52) U.S. Cl.
USPC ..... 2/69; 2/82; 2/87; 602/3; 602/60

(58) Field of Classification Search
USPC ..... 2/67, 102, 77, 113–115, 82, 103, 2/462, 48–51, 69
See application file for complete search history.

(56) References Cited

U.S. PATENT DOCUMENTS 3,023,419 A * 3/1962 Strahle ..... 2/80
3,329,144 A * 7/1967 Liman ..... 602/3
3,824,625 A * 7/1974 Green ..... 2/114
4,562,834 A * 1/1986 Bates et al. ..... 602/3
4,698,848 A * 10/1987 Buckley ..... 2/114
4,911,151 A * 3/1990 Rankin et al. ..... 602/3
5,003,635 A * 4/1991 Peterson ..... 2/69
5,027,438 A * 7/1991 Schwarze et al. ..... 2/114
5,063,919 A * 11/1991 Silverberg ..... 602/3
5,142,702 A * 9/1992 Piloian ..... 2/102
5,526,532 A 6/1996 Willard
5,592,953 A * 1/1997 Delao ..... 128/882
5,817,038 A * 10/1998 Orange et al. ..... 602/3
5,924,130 A * 7/1999 Fragomeli ..... 2/16
6,032,289 A * 3/2000 Villapiano ..... 2/102
RE36,869 E * 9/2000 Ewen ..... 450/1
6,237,152 B1 * 5/2001 Gootrad ..... 2/87
6,308,344 B1 * 10/2001 Spink ..... 2/458
6,374,414 B1 * 4/2002 Collier ..... 2/69
6,574,799 B2 * 6/2003 Donaldson ..... 2/16
7,293,295 B2 11/2007 King
7,827,619 B1 * 11/2010 Steinberg et al. ..... 2/114
2003/0126675 A1 7/2003 Blauer et al.
2003/0140391 A1 * 7/2003 Richards et al. ..... 2/67
2003/0150044 A1 * 8/2003 Hoy ..... 2/125
2004/0215118 A1 * 10/2004 Dumas et al. ..... 602/3
2006/0053525 A1 * 3/2006 Legard ..... 2/114
2007/0113316 A1 * 5/2007 King ..... 2/102
2007/0157362 A1 * 7/2007 Rogers ..... 2/114
2008/0282441 A1 11/2008 Green
2008/0312615 A1 * 12/2008 Hunter ..... 604/345
2009/0089913 A1 * 4/2009 Ehrlickman ..... 2/83
2009/0089983 A1 * 4/2009 Meager ..... 24/387

* cited by examiner

*Primary Examiner* — Khoa Huynh
*Assistant Examiner* — Khaled Annis
(74) *Attorney, Agent, or Firm* — Clark & Brody

(57) ABSTRACT

A shower shirt has waterproof seals at its neck opening, arm openings and shirt bottom to prevent water from contacting a person's body that is enclosed by the shirt. The shower shirt also has one or more pockets sized to support post surgical devices associated with the patient such as drain tubes, bulbs, dialysis/external catheters, wound vac and infusion pumps. The shower shirt can also include baffles to provide additional lateral breast support to the patient.

9 Claims, 1 Drawing Sheet

SHOWER SHIRT AND METHOD OF USE

This application is a continuation of PCT/US/2010/61435 filed on Dec. 21, 2010, and priority under 35 USC 119(e) based on provisional patent application no. 61/290,031 filed on Dec. 24, 2009 is claimed, with both applications herein incorporated by reference in their entirety.

FIELD OF INVENTION

The present invention relates to a shower shirt and particularly to a shirt designed for use by patients who have undergone mastectomies, augmentation, reconstruction, breast lift, mastopexy, augmentation/mastopexy, breast reduction, and patients needing dialysis/external catheters, wound vacs, and infusion pumps. The present invention is designed to protect not only the wound areas of the mastectomy, reconstruction, augmentation, breast lift, mastopexy, augmentation/mastopexy and reduction patient surgical site, but more importantly, protect the drain site, drain tube, drain bulb, dialysis/external catheters, wound vacs, and infusion pumps while showering/bathing, and also support the weight of the drain tube, drain bulb, and infusion pump while showering/bathing.

BACKGROUND ART

Various garments and other wearing apparel have been proposed to protect parts of a person's body when taking a shower. These items are designed to be worn over a limb or a person's torso.

However, these types of protective gear do not take into account the fact that many patient's must have drain tubes and bulbs or other medical post surgery devices that penetrate the body, and stay with the patient as part of their post operative rehabilitation. Therefore, a need exists for improved garments in this respect. The present invention satisfies this need by providing a shower shirt that is designed to keep a user's body and any medical components linked to the body dry during showering as well as providing inner pockets and drain tube loops or straps to support the weight of the medical components, while also keeping the medical tubing in place.

SUMMARY OF THE INVENTION

The invention relates to a shower shirt designed to be worn by a patient while taking a shower. The shower shirt is designed with closures associated with its openings to prevent water from flowing beneath the shirt. The shower shirt is also designed with pockets to support the drain tubes/bulbs, external catheters, wound vacs and infusion pumps normally present in post operation treatment.

In one embodiment, the shower shirt is a one piece waterproof shirt designed to protect breast surgery patients who have undergone mastectomies, augmentation, reconstruction, breast lift, mastopexy, augmentation/mastopexy and breast reduction procedures from the risk of water invading the surgical sites of the breast incisions, surgical drains, drain tubes, drain bulbs, external catheters, wound vacs and infusion pumps while bathing or showering. The shower shirt will not only provide waterproof support for the breast incisions and surgical area, but also structural support for the above surgical devices, and optionally with breast baffles for lateral breast support.

In addition, the structurally supportive drain pockets will host the surgical drain tube, drain bulb, external catheter, wound vac and infusion pump mechanics, along with an internal loop pocket to hold the multiple 'post' surgical devices in place. The majority of surgical drains (normally 4 to 6) utilized for the above procedures are required to be sutured into these types of surgery patients for at least two to three weeks, and months at a time for dialysis patients, preventing patients from bathing or showering appropriately post surgery. This type of product will help the patient emotionally, by giving them the freedom to bathe or take a shower before the timeframe when the drain devices are normally removed; the product will help the patient physically by protecting them from water invasion in and around their surgical incisions and drain sites, and structurally, by supporting the weight of the post surgical devices. The surgical devices sutured into or under the armpit, or along the chest or torso region of these patients can be a direct portal into the surgery site possibly causing a surgical site infection from the bacteria and pathogens in tap water. The shower shirt is designed to decrease the risk of these types of post-surgical infections.

The waterproof 'shower' shirt invention is designed for mastectomy, augmentation, reconstruction, mastopexy, augmentation/mastopexy and breast reduction patients required to have drains placed (post-surgery) under the armpit or a lower location on either side of the chest for fluid drainage from the breast area. The shower shirt can be molded into a short sleeve shirt made of a plastic, parachute, or nylon material, comparable to the materials utilized for a thick shower cap, with elastic around all perimeters. The shower shirt can be designed with a turtle neck feature at the top of the shirt with a terry cloth fabric liner and elastic edges to fit tightly under the jaw line. This terry cloth fabric can also be included as part of the arm and body openings if so desired. In addition, a draw string, cinch strap, hook and loop fastener band can be added at the top of the turtleneck to add an additional seal to further deter any moisture from seeping into or under the shirt while a patient is showering/bathing. For purposes of this disclosure, showering is intended to encompass both showering and bathing.

The shower shirt can have a solid plastic/nylon frontal area with capped sleeves on each arm. The sleeves are optimally designed to hit immediately below the upper arm/deltoid area, and to fit snugly via the elastic surrounding the arm. In addition, a draw string or hook and loop fastener band could be added to the perimeter of each sleeve adding additional support to prevent moisture seepage from entering the side of the shirt under or around the armpit. The shower shirt is sized to fit loosely under the armpit in order to avoid putting any pressure on or around the post-surgical drain device tubes sutured to, and entering the armpit. The shower shirt also includes internal drain pockets to host the weight of the drain tubes, drains bulbs, external catheters, wound vacs and infusion pumps while showering/bathing. The drain pockets are located on the inside of the shirt and can be made in various sizes. One exemplary size would be 3 or 6 inches by 3 inches.

The length of the shower shirt to form the bottom opening can vary as well. In one embodiment, the length can extend between two and four inches under the chest/breast area with additional elastic edges fitting snugly under the chest, or torso area. The length can be longer to extend so that the shirt bottom opening terminates near the waist, at the waist, or even below the waist.

Breast baffles can also be integrated into the garment for support. In one mode, the baffles can be located on each side of the shower shirt under the armpits and/or on each side (vertical) of the breast area to provide lateral support to both the breasts and incision areas.

In addition, drain tube loops or straps can be added under the breast baffles to hold the drain tubes in place when sliding the drain bulbs into the drain pocket enclosures.

The shirt can also include a waterproof zipper in the front portion of the 'shirt' to enable patients to easily slide arms into the sleeves of the shower shirt without being required to elevate arms post surgery. The zipper enclosure is waterproof in nature with a waterproof work flap and Velcro® strip covering the outside and entire length of the zipper. Another example is one that also includes a waterproof flap behind the zipper enclosure, keeping the shirt from any potential water seepage.

The shower shirt could also have snap closures under each armpit extending to the bottom of the shirt to easily maneuver patients into the shirt w/o extending the arms up or out. A double-breasted front closure design using waterproof plastic snaps which would overlay across the front and close can also be employed as an alternative to a zipper.

The shower shirt will come in any number of sizes, S/M, and L/XL. The product can also be made of other material that would not necessarily be the type that could be recycled, but would still have the waterproof and sealing attributes described above.

One advantage of the invention is the ability to provide a sense of independence and dignity during recovery to those patients who have undergone mastectomy procedures due to breast cancer. Because this product is a one piece invention created to be utilized by the patient as a shower shirt, the patient can place the product on the body without support of a second person.

DESCRIPTION OF THE PREFERRED EMBODIMENTS

Figure 1:
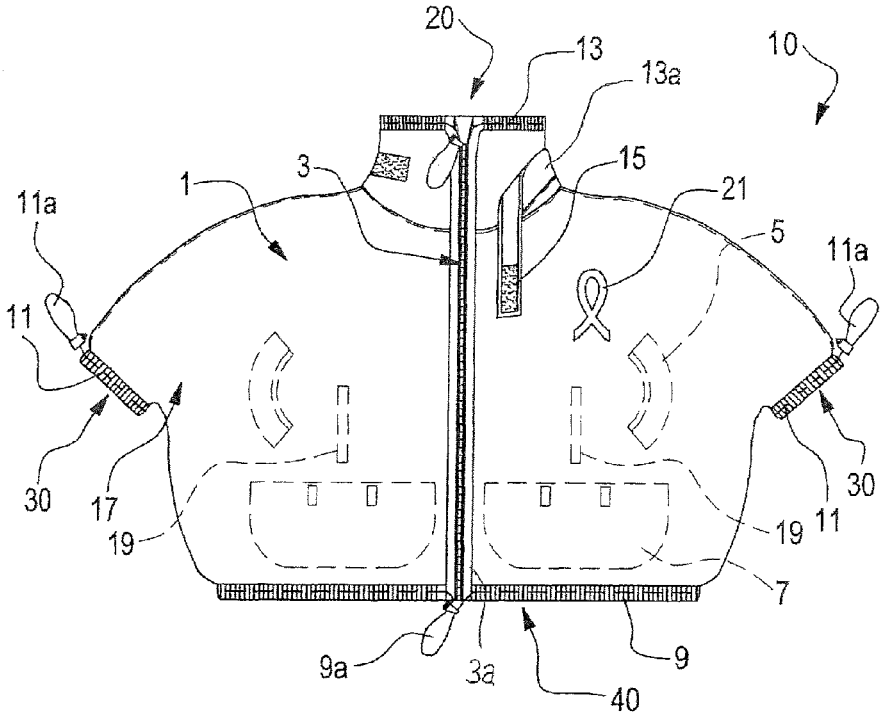
FIG. 1 shows a front view of shirt according to the invention.
Figure 2:
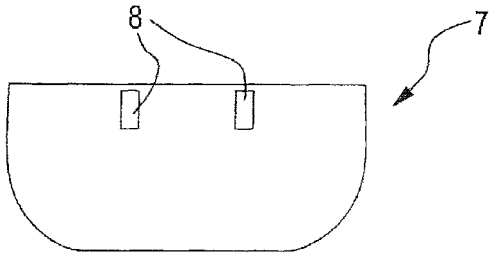
FIG. 2 shows a detail of a drain pocket of the shirt of FIG. 1.

With reference to FIGS. 1 and 2 of the drawings, the shower shirt assembly is represented by the reference numeral 10 and includes a shirt 1 that is made from a waterproof material to protect the patient from water invasion while showering/bathing.

In this disclosed embodiment, shirt 1 includes a waterproof zipper 3 to keep water seepage from entering the shower shirt and waterproof work flap 3*a* located behind the waterproof zipper to lend additional water seepage support. The flap can also be located over the waterproof zipper if so desired. Optionally, two inner breast baffles 5 are located laterally from the breasts to provide lateral support to both the breast and incision area. The baffles can be made from any material with a preferred material being a washable/flexible styrofoam type padding with outer layers of soft, fabric, and attached to the shirt in any conventional fashion, stitching, adhesive, velcro, fasteners, or a combination of one or more of these attachment means.

Two inner pockets 7 are located on an inside of the shirt on a front side thereof to structurally support post surgical devices, e.g., a drain tube and/or drain bulb). It is preferred to have the pockets 7 on the inside front of the shirt 1, but other locations can also be employed, i.e., the back and sides. The pockets can be of any size provided that they can hold at least one post surgical devices, e.g., a drain bulb or a portion of the tubing and drain bulb, wound vac, catheter or infusion pump(s). While two pockets are disclosed, a single pocket or more than two pockets could be employed depending on the post surgical devices associated with the patient. A single pocket would be sized to accommodate all of the post surgical devices. The pockets can be made from the same material as the shirt or a different material if so desired. The pockets can be attached using stitching, adhesives, mechanical fastening, or a combination of one or more of these fastening techniques.

The pockets 7 can include hook and loop fasteners 8 on the inside of the pockets to keep the pockets closed, if desired. While hook and loop fasteners are disclosed, other means for keeping the pockets closed, e.g., snaps, buttons, etc. could be used in place of the fasteners 8.

The shirt 1 is made with a neck opening 20, a pair of arm openings 30, and a shirt bottom opening 40. The bottom opening 40 has an elastic band 9 that forms a watertight seal. The shirt 1 is shown with a low-to-mid torso length but other lengths such as nearer to the waist, at the waist, or even below the waist, if so desired, can be used.

The arm openings 30 each have elastic sleeve bands 11 to keep water from seeping in under the armpit area. Each arm opening can also have a cinch strap 11*a* w/hook and loop fastening means to support the elastic neck band and provide further sealing against water entry. The cinch strap is a strap with one end attached to shirt near the arm opening and the other end having either hooks or loops of hook and loop fastening means. The complementary hooks or loops are located on the shirt. Pulling the strap cinches the arm opening and the strap in the cinched position is held in place by attaching the free end of the strap with hooks, for example, to loops on the shirt. While the cinch strap is described with hook and loop fastening means, other fastening means such as snaps, buttons, clips, a drawstring, etc. can be used.

The neck opening 20 has an elastic neck band 13 to keep the shower shirt fitted snugly under the jawline keeping water from invading into the top of the shower shirt. The neck opening can also have a neck cinch strap 13*a* w/hook and loop fastening means 15 to support the elastic neck band and provide further sealing against water entry. While the cinch strap is described with hook and loop fastening means, other fastening means such as snaps, buttons, drawstrings, clips, etc. can be used Each sleeve casing 17 is sized to cover the shoulder area and drain suture locations, with the capped sleeves designed to fit snugly around the deltoid area of the upper arm to keep water from seeping in under the armpit area and to also form a protective waterproof casing around the drain sutures, which are typically sutured under the armpit, torso, or chest region.

The shirt 1 can also include a pair of inner drain tube straps 19 w/hook and loop fastening means to keep internal drain tubes in place. These straps, when ends are linked together by the hook and loop fastening means, form a loop to support the drain tube extending from the patient's body to the drain bulb held in the pocket. While hook and loop fasteners are shown, other means for forming a loop can be employed, e.g., straps with snaps, buttons, etc.

The shirt bottom opening can also have cinch strap 9*a* similar to that shown for the neck and arm openings.

The shirt can also display one or more logos as well. A breast cancer logo 21 is shown as an example of a logo. In addition, the shirt can also be worn as a water-resistant fashion item.

The clinical purpose for this product is to reduce post-surgical infections, more commonly known as Surgical Site Infections, or SSI's. Many surgical procedures involve the placement of surgical drains, tubes and catheters placed under the surgery site, and penetrate the skin. These tubes drain fluid, but also can act as a portal for bacteria to enter the wound site. Tap water contains bacteria. Thus exposure to water, while trying to bathe, significantly increases the risk of dangerous post-surgical infections. Patients are routinely instructed by their physicians not to shower until drains are removed, which may span up to three weeks for mastectomy patients, and months for dialysis patients.

The fundamental purpose of the inventive shower shirt is to reduce the risk of infection while permitting post-surgery/mastectomy and dialysis patients to bathe with some degree of normalcy. Before the advent of this product, patients desperately wanting to bathe and feel clean, often resorted to fashioning trash bags or plastic wrap in an effort to protect themselves until their drains or catheters were removed. A trash bag is not a properly designed product to protect any surgical patient from bacteria-laden water and infection.

As such, an invention has been disclosed in terms of preferred embodiments thereof which fulfills each and every one of the objects of the present invention as set forth above and provides a new and improved garment for surgery patients.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. A shower shirt for use by a patient having incisions and post surgical devices adapted to be attached to the patient's body comprising:

a) a shirt, the shirt having a neck opening, arm openings, and a shirt bottom opening, the shirt bottom opening comprising a peripheral edge of the shirt designed to surround a patient's chest or waist, b) a waterproof zipper extending from the neck opening to the shirt bottom opening;

c) the neck opening further comprising a turtle neck configuration designed to extend to the jawline of the patient, the neck opening having an open top end and further having an elastic band and a cinch strap;

d) a waterproof seal at each of the open top end, the arm openings, and the shirt bottom opening; and e) at least one pocket located on an inside of the shirt, the at least one pocket designed to accommodate or support one or more post surgical devices being associated with the patient and at least one loop or strap designed to be placed on the inside of the shirt to support the weight of a component of the one or more post surgical devices.

2. The shirt of claim 1, further comprising at least two pockets.

3. The shirt of claim 1, wherein the waterproof seal of the neck opening includes a hook and loop fastener.

4. The shirt of claim 1, further comprising fasteners for closing the at least one pocket.

5. In a method of donning a protective garment to shield areas of a person's body from water, the improvement comprising donning the shower shirt of claim 1.

6. The method of claim 5, further comprising inserting one or more post surgical devices into the at least one pocket prior to completely donning the shower shirt.

7. The method of claim 6, wherein the shower shirt has at least two pockets, and one or more post surgical devices is inserted into each pocket.

8. The method of claim 6, wherein the post surgical device is at least a drain bulb or a drain bulb and at least a portion of a drain tube associated with the drain bulb.

9. The shirt of claim 1, wherein the shirt is made of a nylon or parachute material.

* * * * *